US012753553B2

(12) United States Patent
Ayoub et al.

(10) Patent No.: US 12,753,553 B2
(45) Date of Patent: Oct. 6, 2026

(54) LOW CELLULOSIC NON-WOOD FIBER PRODUCTS AND METHODS OF MAKING THE SAME

(71) Applicant: Archer Daniels Midland Company, Decatur, IL (US)

(72) Inventors: Ali Ayoub, Decatur, IL (US); Baljit Ghotra, Champaign, IL (US); Darrell V. Chenault, Valparaiso, IN (US); Alexandra Sanborn, Lincoln, IL (US)

(73) Assignee: ARCHER-DANIELS-MIDLAND COMPANY, Decatur, IL (US)

( * ) Notice: Subject to any disclaimer, the term of this patent is extended or adjusted under 35 U.S.C. 154(b) by 689 days.

(21) Appl. No.: 18/002,157

(22) PCT Filed: Jun. 18, 2021

(86) PCT No.: PCT/US2021/038021
§ 371 (c)(1),
(2) Date: Dec. 16, 2022

(87) PCT Pub. No.: WO2021/257948
PCT Pub. Date: Dec. 23, 2021

(65) Prior Publication Data

US 2023/0332357 A1 Oct. 19, 2023

Related U.S. Application Data

(60) Provisional application No. 63/040,788, filed on Jun. 18, 2020.

(51) Int. Cl.
*D21H 21/18* (2006.01)
*D21H 17/29* (2006.01)
*D21H 25/04* (2006.01)

(52) U.S. Cl.
CPC ..... *D21H 21/18* (2013.01); *D21H 17/29* (2013.01); *D21H 25/04* (2013.01)

(58) Field of Classification Search
CPC ..... D21H 21/18; D21H 17/02; D21H 17/22; D21H 17/28
See application file for complete search history.

(56) References Cited

U.S. PATENT DOCUMENTS

| | | | | |
|---|---|---|---|---|
| 6,022,450 | A | 2/2000 | Van Kessel et al. | |
| 2005/0067124 | A1 | 3/2005 | Satyavolu et al. | |
| 2006/0113028 | A1* | 6/2006 | Gombert | C09J 103/02 156/210 |
| 2013/0284389 | A1* | 10/2013 | Roux | C08B 31/006 162/175 |
| 2014/0166222 | A1 | 6/2014 | Delrus et al. | |
| 2015/0361618 | A1* | 12/2015 | Salam | D21H 17/36 162/174 |
| 2022/0135854 | A1* | 5/2022 | Skuratowicz | C08K 3/38 428/355 CP |

OTHER PUBLICATIONS

Geerts et al., Understanding functional properties of mildly refined starch fractions of yellow pea, Journal of Cereal Science, Mar. 31, 2017 (Year: 2017).*

* cited by examiner

*Primary Examiner* — Abbas Rashid
*Assistant Examiner* — Elisa H Vera
(74) *Attorney, Agent, or Firm* — Andrew F. Nilles

(57) ABSTRACT

A method of preparing a non-wood fiber paper strengthening product is disclosed. The method comprises placing an additive in an aqueous alkaline medium, wherein the additive comprises a hydroxycarboxylic acid, and mixing a non-wood fiber material with the placed additive in the aqueous alkaline medium to form a mixture, wherein the non-wood fiber material comprises starch, protein and fiber, wherein the additive, starch, protein, and fiber of the non-wood fiber material, and metal ions of the alkaline medium become physically crosslinked resulting in a non-wood fiber paper strengthening product. In an aspect, the non-wood fiber paper strengthening product is used in making a paper product wherein the paper product has greater strength than the same paper product made with native starch or chemically modified starch instead of the non-wood fiber paper strengthening product.

8 Claims, No Drawings

LOW CELLULOSIC NON-WOOD FIBER PRODUCTS AND METHODS OF MAKING THE SAME

CROSS-REFERENCE TO RELATED APPLICATIONS

This application is a national stage entry of International Application No. PCT/US21/038021, filed Jun. 18, 2021, which itself claims priority to U.S. Provisional Patent Application No. 63/040,788, filed Jun. 18, 2020, each of the contents of the entirety of which are incorporated by this reference.

FIELD OF THE INVENTION

The present disclosure relates to low cellulosic products originating from a non-wood fiber material, such as a botanical flour. More specifically, but not exclusively, the present disclosure also relates to a method for the manufacture of low cellulosic non-wood fiber products for use in the paper industry. The present disclosure also relates to a method of improving strength of cellulosic paper products while enhancing the repulpability.

BACKGROUND OF THE INVENTION

In the manufacture of paper products such as cardboard, the strength properties of the final product can be increased by adding so called "strengthening agents." Strengthening agents can also allow for a reduction in the overall basis weight of the paper product to achieve the same paper strength and save on the cost of cellulosic raw materials. Conventional paper strengthening agents include chemically modified starches such as carboxyalkylated starches and cationic starches, urea/formaldehyde resins, melamine/formaldehyde resins, acrylamide copolymers, polyamidoamine/epichlorohydrin resins and chitosan.

Because of increased interest on developing paper products based on recovered cellulose, developing paper which is readily repulpable has received much emphasis. Many conventional repulping processes used for paper products require the use of toxic reagents, proceed slowly, and usually lead to a large amount of waste which is landfilled and pollutes the environment while wasting valuable fiber sources.

US 20140166222A1 discloses a strengthening agent in the wet-end of papermaking, which comprises a surface modified non-wood plant fiber and a chemically modified starch (cationic starch) component.

US 2006225855A describes legume-derived cationic starches. The disclosed composition can be used as a strength agent in the paper industry.

EP 1631718B1 discloses a composition for chemically modified starch, derived from legumes, which is useful in the paper industry.

Although some of these compositions do in fact increase the strengthening properties over native starches using non-wood fiber materials, the methods are not economically practical with increased energy cost, very dilute processing conditions, and high cellulosic materials. Further, these non-wood fiber compositions include chemically modified starches, also referred to as chemically crosslinked starches, wherein intramolecular bonding occurs with the formation of covalent bonds. Thus, the compositions and the processes for producing these compositions cannot be referred to as clean label and the products are not biodegradable.

Still further, conventional methods are silent with respect to the raw low cellulosic materials used to manufacture paper products. Thus, a need exists to search for raw low cellulosic non-wood fiber materials, easy to process, in particular to the solvent used and the strengthening agent or strengthening matrix added, non-toxic and clean label conditions, as well as a repulpable.

It is an object of the present invention to overcome the disadvantages of the above prior art, and provide a low cellulosic non-wood fiber paper strengthening product having the mechanical properties like or to a greater extent than those prepared using conventional methods. There is a need for improved products for application in the paper industry. For example, there is a need for paper products to be made from low cellulosic raw non-wood fiber materials yet have at least the same or similar paper strength as cardboard products made with conventional amounts of high cellulosic raw materials.

SUMMARY

The present invention provides advantages over conventional methods and products. The present invention comprises a composition of a low cellulosic raw fiber material for use as a non-wood fiber paper strengthening agent and a method of improving strength of cellulosic paper products while enhancing the repulpability. In an aspect, the low cellulosic raw non-wood fiber material is a botanical flour. More specifically, the botanical flour is a legume flour or a bean flour. In a preferred aspect, the botanical flour is a pea legume flour. In an aspect, the pea legume flour is a pea legume flour stream from any treatment that promotes size reduction of particles. For example, such treatment may involve various types of grinding or milling (e.g., dry milling, wet milling, wet fractionation, or vibratory ball milling). In an aspect, the preferred treatment is a wet fractionation process wherein the pea legume flour comprising starch, proteins, and fibers.

In an aspect, the present invention is a method of making a starch-containing product made from low cellulosic raw non-wood fiber materials, wherein the starch-containing product has greater paper strength as conventional cardboard products made with conventional amounts of high cellulosic raw wood materials. As used herein, the term "paper strength" includes at least one strength characteristic commonly used in the paper industry, e.g., tensile strength (TAPPI method T-404) or bursting strength (Mullen Index test, also known as the TAPPI method T-403). In an aspect of the present invention, a method comprises mixing non-wood fiber material, in particular, a botanical flour, and an old corrugated container pulp slurry to form a mixture; heating the mixture; preparing a uniform sheet using the mixture; and drying the sheet to produce a paper product; wherein the paper product has a paper strength greater than a paper product made in the same manner but with native starch or chemically modified starch.

In an aspect of the present invention, a method comprises placing an additive in an aqueous alkaline medium and adding to the medium a non-wood fiber material comprising starch, protein and fiber, wherein the additive, non-wood fiber material, and metal ions of the alkaline medium become physically crosslinked resulting in a low cellulosic non-wood fiber paper strengthening product. In an embodiment, the non-wood fiber material is a botanical flour. As used herein, the term "physically crosslinked" means linking by at least one interaction chosen from intermolecular forces, hydrogen bonds, ionic bonds, complexation, and electrostatic interaction. In an aspect, the physical linking is achieved due to abundant hydroxyl groups in the starch and additive, carboxylate groups of the additive, functional groups of the protein, and alkali metal of the medium. In an aspect, the non-wood fiber paper strengthening product may be used to make a cardboard, wherein the cardboard has at least the same paper strength and is derived from low cellulosic raw non-wood fiber materials than a cardboard made with a chemically modified product rich.

In an aspect, the method is performed solely in an alkaline aqueous medium and absent of a co-solvent, wherein the amount of botanical flour is greater than 20% by weight of mixture.

In an aspect, the additive is a hydroxycarboxylic acid. As used herein, hydroxycarboxylic acid is intended to mean any acid having at least one hydroxyl functional group and at least one carboxylic acid functional group.

In an aspect, the mixing of the additive in an alkaline aqueous medium and the botanical flour is conducted in a semi-dry process step, e.g., less than 30% moisture by weight of the mixture. In an aspect, the method is performed at a pH equal to or greater than 8.

In an aspect, after mixing the additive in an alkaline aqueous medium and the botanical flour, the mixture is heated, e.g., in an oven. In an aspect, after heating, the product is washed with water and dried.

In yet a further aspect, the present disclosure relates to the use of non-wood fiber paper strengthening products in paper products, in absorbent paper products, in packaging materials, and in filters.

These and other aspects, embodiments, and associated advantages will become apparent from the following Detailed Description.

DETAILED DESCRIPTION

In order to provide a clear understanding of the terms used in the present description, a number of definitions are provided below.

As used in this description and claim(s) the term "comprising" and its derivatives, as used herein, are similarly intended to be open ended terms that specify the presence of the stated features, elements, components, groups, integers, and/or steps, but do not exclude the presence of other unstated features, elements, components, groups, integers and/or steps. This understanding also applies to words having similar meanings, such as the terms "including", "having" and their derivatives. The term "consisting" and its derivatives, as used herein, are intended to be closed terms that specify the presence of the stated features, elements, components, groups, integers, and/or steps, but exclude the presence of other unstated features, elements, components, groups, integers, and/or steps.

As used in this description and claim(s), the term "about" is defined as being close to, and in one non-limiting aspect the term is defined to be within 5%, preferably within 1%, and more preferably within 0.5%.

As used herein, the term "physically crosslinked", "crosslinking", "linked", refers to linking by at least one interaction chosen from intermolecular forces, hydrogen bonds, ionic bonds, complexation, and electrostatic interactions. Non-limiting examples of these physical crosslinking interactions include the interaction of hydroxyl groups contained in the starch and additive, carboxylate groups of the additive, the functional groups contained in the proteins, and the alkali metal of the medium, or any combination thereof.

Examples of suitable starches include corn starch, sweet potato starch, potato starch, tapioca starch, wheat starch, related vegetable starches, and hydrolyzed starches. In a preferred example, the starch is a corn starch.

As used herein, the terms "paper" and "cardboard" are used interchangeably. As used herein, the term "non-wood fiber" generally refers to any material which is not derived from wood, wherein wood is understood to mean the hard, fibrous material found beneath bark in the stems and branches of trees. Suitable non-wood fiber materials can be from agricultural residues, grasses, botanicals or other plant materials such as straw, leaves, bark, seeds, hulls, flowers, vegetables or fruits or from cotton, corn, wheat, oat, rye, barley, rice, soy, flax, hemp, bagasse, bamboo or reed. Agricultural residues originate from root or tuber, maize, pea, wheat or combinations thereof. Non-wood fiber can also be from algae or fungi or of bacterial origin.

As used herein, "non-wood fiber paper strengthening product" is well-suited for use as strengthening agents in the paper industry, for use as packaging materials, and for use as paper products. Non-limiting examples of such packaging materials are labels, corrugated boxes, liquid packaging board (milk carton, juice carton, beverage carton), folding and non-folding cartons and boxes. This may include a packaging material used to protect the display portion of an electronic device, e.g., a laptop, a smartphone, or a smartwatch. The non-wood fiber paper strengthening products of the present invention are also suitable for use in absorbent paper products (e.g., napkins, tissues, and liners), adhesives, and filters (e.g., cigarette filters and water filters).

As used herein, the expression "legumes" or "legume origin", for the purposes of the present invention, is understood to mean representatives of the bean, pea, lentil, alfalfa, clove and lupine, and in particular pea legume, being preferred in the present invention.

Thus, unless otherwise indicated, any definitions or embodiments described in this or in other sections are intended to be applicable to all embodiments and aspects of the subjects herein described for which they would be suitable according to the understanding of a person of ordinary skill in the art.

In an aspect is a composition of low cellulosic raw non-wood fiber materials for use as a non-wood fiber paper strengthening agent. For example, a low cellulosic non-wood fiber material is a botanical flour, such as a pea legume flour. The pea legume flour may be a pea legume containing stream from various types of treatment, including but not limited to wet milling, dry milling, vibratory ball milling, or any process known in the art. In an aspect, the wet fractionation process is preferred, wherein the raw low cellulosic pea legume flour side-stream comprises biobased substituents. In yet a further aspect of the present disclosure, the pea legume flour side-stream comprises starch, protein, and fiber. In particular, the non-wood fiber material, or combinations thereof, may comprise from about 70% to about 85% by weight starch, equal to or greater than 5% up to 10% by weight protein, and from about 5% to about 25% by weight fiber with about 2% by weight low fat matter or less, and may further comprise less than 10% by weight moisture (i.e., water). The starch content of the flour is preferably less than 85% by weight, more preferably less than 80% by weight, and most preferably less than 75% by weight.

In an aspect, the non-wood fiber paper strengthening product or agent has all the characteristics which have been listed above. These also apply to any combination of non-wood fiber materials.

In an aspect, the composition further comprises a hydroxycarboxylic acid. In an aspect of the present invention, a method comprises placing an additive in an aqueous alkaline medium and adding to the medium a non-wood fiber material comprising starch, protein and fiber, wherein the additive, non-wood fiber material, and metal ions of the alkaline medium become physically crosslinked resulting in a low cellulosic non-wood fiber paper strengthening product.

In an aspect, the present invention is a method of preparing a non-wood fiber paper strengthening product from a non-wood fiber material such as a legume or bean flour, comprising (1) obtaining a legume or bean flour side-stream from a wet fractionation process, the legume or bean flour side-stream comprising starch, protein and fiber, (2) placing an additive in an aqueous alkaline medium, and (3) adding the legume or bean flour side-stream to the medium, wherein the additive, legume or bean flour side-stream, and metal ions are physically crosslinked. In an aspect, the non-wood fiber paper strengthening product is used in making cardboard, wherein the cardboard has at least the same paper strength and is derived from low cellulosic raw materials than a cardboard made with a chemically modified product.

The method disclosed herein using a low cellulosic raw non-wood material originating from a botanical flour, such as a legume or bean flour is advantageous from an economical perspective over conventional methods and products. The cost of the low cellulosic raw material is much less than the cost of chemically modified and native starches. Energy cost is reduced substantially due to the elimination of purifying native starch from the protein and fiber substituents. Advantageously, the method and low cellulosic non-wood fiber material of the present invention comprises a botanical flour, such as a low cellulosic raw legume or bean flour, as opposed to starch and protein concentrates and isolates. Surprisingly, it has been found that use of low cellulosic pea legume flour has good mechanical properties in papermaking not exhibited by starch concentrates and chemically modified starches. The strengthening properties of the low cellulose non-wood fiber product formed with such flour are suitable for use in the paper and packaging industry to make a wide variety of products.

In an aspect, the non-wood fiber paper strengthening product or agent has all the characteristics which have been listed above. These also apply to any combination of non-wood fiber materials.

In an aspect, the alkali of the alkaline aqueous medium is chosen from one of sodium hydroxide, lithium hydroxide, potassium hydroxide and mixtures thereof. The preferred alkali is sodium hydroxide.

In an aspect, the additive is a hydroxycarboxylic acid. Preferably, the hydroxycarboxylic acid is glucaric acid or a derivative of glucaric acid. Moreover, any salt of such acids to form the carboxylate ions can also be used in the present invention as a strengthening agent. It has been found that carboxylates exhibit strong intermolecular bonds beneficial for obtaining enhanced mechanical and strengthening properties of cardboard and packaging containers. Without being bound by theory, the ionic character of carboxylates allows for formation of strong intermolecular bonds between the carboxylates, starch, protein, and fiber of the non-wood fiber material, and metal ions of the alkaline medium so that they become physically crosslinked resulting in a non-wood fiber paper strengthening product. The non-wood fiber paper strengthening product provides enhanced mechanical and strengthening properties suitable for incorporation in paper industry products and the like. Surprisingly, the non-wood fiber paper strengthening product, which is a starch-containing product made from low cellulosic non-wood fiber materials, provides at least the same or similar paper strength as conventional cardboard products made with conventional amounts of high cellulosic raw wood materials.

The glucaric acid may have the structure of formula (I) as follows:

(I)

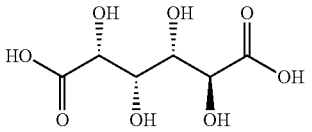

In other aspects, the glucaric acid may be in the form of a carboxylate salt and have the structure of formula (II)

(II)

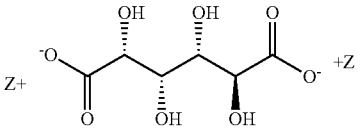

Wherein Z+ is chosen from one of hydrogen, sodium, potassium, or lithium, and combinations thereof. In an embodiment, the glucaric acid may be in the form of a carboxylate salt and have the structure of formula (II) comprising an alkali metal, such as sodium, potassium, or lithium, and combinations thereof.

The glucaric acid may be provided via microorganism fermentation, oxidation of a sugar (e.g., glucose) or polysaccharide (e.g., starch). As such, the glucaric acid is readily available and may be provided in an economically green manner.

In an aspect, the salt of the hydroxycarboxylic acid is generated in situ, which means combining the composition in accordance with the invention a hydroxycarboxylic acid, such as glucaric acid, and an appropriate alkali, such as sodium hydroxide. It should be noted these conditions are unique with care being taken to avoid basic catalysis capable of substantially damaging and hydrolyzing the starch component or degrading the protein to amino acids in the pea legume flour side-stream.

In order to obtain a suitable carboxylate content, the pH of the mixture is preferably at least 8.0.

The composition may include the glucaric acid from greater than 0% to about 25% by weight of the composition, such as from about 3% to about 20% by weight of the composition. The composition may include the botanical flour, such as pea legume flour side-stream, and glucaric acid at a weight ratio of from about 10:1 to about 0.5:1 (botanical flour/glucaric acid), such as from about 5:1 to about 1:1.

In an aspect, the mixing of the additive and botanical flour is in a method step of less than 50% moisture by weight of the mixture.

In an aspect, a method is disclosed that provides a high volume of production and minimizes side-products by physically crosslinking the substituents of botanical flour, such as pea legume flour, to generate an advantageous product matrix containing starches, fibers and proteins, with a polyhydroxycarboxylic acid such as glucaric acid or a salt thereof, a metal ion, and combinations thereof.

In an aspect, the method includes heating the mixture of the additive, botanical flour (such as a pea legume flour), and aqueous alkaline medium to a temperature of at least 80° C., preferably to within 80-105° C., and more preferably to within 90-105° C., and held there for a sufficient time to achieve the product matrix but not so long as to allow excessive damage or hydrolysis to the biobased substituents. In an embodiment, the heating time may be about 90-180 minutes. Generally, the overall heating time should not exceed about 3 hours. Those skilled in the art, having the benefit of the present invention, will readily be able to adjust the reaction time and temperature to optimize the strengthening properties of the product matrix without undue experimentation.

In an aspect, by introducing the non-wood fiber material composed of low cellulosic botanical flour (e.g., a legume or bean flour) according to the present disclosure, to the method of papermaking, paper can be obtained that has substantially the same or enhanced properties as paper wherein chemically modified starch (e.g., cationic starch, chemically crosslinked) is used. Moreover, a low cellulosic non-wood fiber material treated according to the invention can be used as adhesive for fixing corrugations in corrugated cardboard.

In an aspect, a method of improving the mechanical properties of a cellulosic paper comprising adding to the paper during the papermaking process, components of the present invention comprising the low cellulosic non-wood fiber product originating from low cellulosic non-wood fiber material has generally been achieved. The process for manufacturing paper products or the repulpable paper products according to the present invention comprises forming an aqueous slurry of papermaking fibers or pulp or which can be performed by known conventional pulping processes. Another step comprises adding to the aqueous slurry of paper making fibers or pulp, the products of the present invention comprising the non-wood fiber materials or non-wood fiber products. Without being bound by theory, the non-wood fiber materials or non-wood fiber products forms strong physically crosslinked bonds to the pulp fibers. Furthermore, because of the multi-functional structures of pulp fibers and non-wood fiber products of the present invention, strong physical linkages improve the mechanical properties of paper for use in the paper industry.

In an aspect, the present disclosure relates to a non-wood fiber paper product originating from a low cellulosic raw material characterized by a tensile strength of at least 40 Nm/g and a burst strength of at least 2.0 KN/g. These physical characteristics of tensile strength, based on the TAPPI method T-404, and bursting strength, based on the Mullen Index test, also known as the TAPPI method T-403, meet typical specifications in the paper industry.

In an aspect, repulpable and biodegradable non-wood fiber paper strengthening agents are disclosed.

The present invention is more particularly illustrated by the examples which follow.

EXAMPLES

The methods and product matrices disclosed herein are illustrated in the following examples. From the above discussion and these examples, one skilled in the art can ascertain the essential characteristics of this invention, and without departing from the spirit and scope thereof, can make various changes and modifications of the invention to adapt it to various uses and conditions.

The present invention is more particularly illustrated by the examples which follow.

All commercial reagents were used as received. Native corn starch ADM® Clinton 106, cationic starch ADM® Clin-Cat 830 with a degree of substitution of 0.1, and cationic starch ADM® Clin-Cat 810 with a degree of substitution of 0.04, glucaric acid (Sigma Aldrich), sodium hydroxide (Sigma Aldrich), and low cellulosic raw pea legume flour side-stream (Archer Daniels Midland Company, ADM). An old corrugated container ("OCC") pulp slurry was prepared from cardboard boxes (Amazon) after pulping with water. Non-wood fiber paper strengthening products were produced according to a preferred embodiment of the present invention.

The following abbreviations are or may be used in the examples: "RPM" mean revolutions per minute; "DS" means degree of substitution; "° C." means degrees Celsius; "KN" means kilonewtons; "Nm/g" means newtons per meter per grammage; "L" means liter; "mL" means milliliter; "min" means minutes; "OCC" means old corrugated container; and "g" means grams.

Examples 1 and 2 relate to the preparation of two products of low cellulosic pea legume side-stream, glucaric acid, and alkali metals for use as repulpable and biodegradable non-wood fiber paper strengthening products. The strengthening products were prepared by placing glucaric acid in desired amounts of either 1 g or 5 g in 20 mL of alkaline aqueous medium (0.1N sodium hydroxide) in a 50 mL cup. The low cellulosic pea legume flour side stream was added to the cup and the slurry was vigorously mixed using a spatula. The resulting slurry was then placed in a conventional oven and heated to 105° C. for 90 minutes. The mixture was removed and allowed to dry at room temperature. These non-wood fiber paper strengthening product comprising the glucaric acid additive were subsequently tested in the manufacture of paper sheets.

The protocol for preparation of laboratory hand sheets was based on a procedure derived from TAPPI Standard Method T 205. The chosen matrix or strengthening agent (0.5 g) was added to an OCC pulp slurry (0.3% in water, 10 L) in a plastic bucket. The slurry was stirred at 500 rpm for 15 min. The temperature of the mixing slurry was maintained at 35° C. with a pH 6. The uniform sheet was prepared using 500 mL of prepared slurry. The sheet was dried in a condition room and cured at 110° C. for 45 min. For each sheet of paper produced, the traditional physical characteristics such as tensile strength and bursting strength were determined and found to be satisfactory for use in paper products.

The above mentioned general procedure for the manufacture of paper sheets was followed for incorporating the matrices of Examples 1-2, a control of low cellulosic pea legume flour (Example 3), and conventional strengthening agents such as native corn starch (Example 4) or cationic starches (Examples 5-6) into paper used for comparative testing. Table 1 summarizes the mechanical properties of non-wood fiber paper strengthening agents made in accordance with the present invention to conventional strengthening agents.

TABLE 1

| Example | Strengthening Agent or Product | Tensile index (Nm/g) | Bursting index (KN/g) |
|---|---|---|---|
| 1 | Pea Legume Flour:Glucaric Acid (5:1) | 46 | 2.6 |

TABLE 1-continued

| Example | Strengthening Agent or Product | Tensile index (Nm/g) | Bursting index (KN/g) |
|---|---|---|---|
| 2 | Pea Legume Flour: Glucaric Acid (1:1) | 52 | 2.7 |
| 3 | Pea Legume Flour | 43 | 2 |
| 4 | Native Starch | 34 | 1.6 |
| 5 | Cationic Starch (DS = 0.04) | 35 | 1.7 |
| 6 | Cationic Starch (DS = 0.1) | 38 | 2.1 |

Examples 1 and 2 show the benefit of a low cellulosic non-wood fiber material comprising a raw pea legume flour, in particular a composition of 70% starch, 8% protein, 16% of fibers, 1% fat, and 5% moisture, accompanied by glucaric acid in terms of mechanical and strengthening characteristics. As outlined in Table 1, such novel non-wood paper strengthening products of Examples 1 and 2 clearly demonstrate excellent mechanical properties in comparison to the conventional strengthening agents (e.g., native starch and chemically modified starches) of Examples 4-6.

Example 3 relates to and in a particularly surprising and unexpected manner, the addition of a sole low cellulosic pea legume flour to the paper-making process, has improved tensile strength when compared to the conventional strengthening agents of Examples 4-6. The addition of only a low cellulosic pea legume flour, has when, compared with the native starch and cationic starch of low degree of substitution, a significant advantage in terms of bursting index as appears in Examples 3, 4, and 5 and like bursting index of a highly substituted cationic starch as appears in Example 6.

This disclosure has been described with reference to certain exemplary embodiments, compositions, and uses thereof. However, it will be recognized by those of ordinary skill in the art that various substitutions, modifications, or combinations of any of the exemplary embodiments may be made without departing from the spirit and scope of the disclosure. Thus, the disclosure is not limited by the description of the exemplary embodiments, but rather by the appended claims as originally filed.

What is claimed is:

1. A method comprising:

placing an additive in an aqueous alkaline medium, wherein additive comprises a hydroxycarboxylic acid;

mixing a non-wood fiber material with the additive in the aqueous alkaline medium to form a mixture, wherein the non-wood fiber material comprises starch, protein and fiber;

wherein the non-wood fiber material is about 70-85% by weight starch, about 5-10% by weight protein, about 5-25% by weight fiber, about 1-2% by weight low fat matter or less, and about 5-10% by weight moisture or less;

wherein the additive, components of the non-wood fiber material, and metal ions of the alkaline medium become a non-wood fiber paper strengthening product.

2. The method of claim 1, further comprising heating the mixture at a temperature of at least 80° C.

3. The method of claim 1, wherein the mixing is conducted in less than 30% moisture by weight of the mixture.

4. The method of claim 1, wherein the non-wood fiber material is less than 75% by weight starch.

5. The method of claim 1, wherein the non-wood fiber material is a pea legume flour.

6. The method of claim 1, further comprising incorporating the non-wood fiber paper strengthening product in a paper to form a strengthened paper, wherein the strengthened paper has greater strength than a paper having a native starch or chemically modified starch as a strengthening agent.

7. The method of claim 1, further comprising:

preparing a uniform sheet using the mixture; and drying the sheet to produce a paper product;

wherein the paper product has a tensile strength and bursting strength greater than a paper product made in the same manner but with native corn starch or chemically crosslinked cationic corn starch.

8. The method of claim 7, wherein the non-wood fiber material is pea legume flour.

* * * * *